United States Patent [19]

Dawson

[11] 4,304,081

[45] Dec. 8, 1981

[54] FRAMES FOR WINDOWS AND OTHER PANELS

[75] Inventor: Charles D. Dawson, Winchcombe, England

[73] Assignee: Reddiplex Limited, Droitwich, England

[21] Appl. No.: 149,504

[22] Filed: May 13, 1980

[30] Foreign Application Priority Data

May 12, 1979 [GB] United Kingdom ..... 16569/79

[51] Int. Cl.[3] ..... E04C 1/00

[52] U.S. Cl. ..... 52/309.13; 52/730; 49/DIG. 1

[58] Field of Search ..... 52/730, 731, 732, 309.13; 49/DIG. 1, DIG. 2

[56] References Cited

U.S. PATENT DOCUMENTS 3,093,217 6/1963 Doede ..... 49/DIG. 1 X 3,975,881 8/1976 Ninowski ..... 49/DIG. 1 X

FOREIGN PATENT DOCUMENTS 672740 3/1966 Belgium ..... 49/DIG. 1

*Primary Examiner*—Price C. Faw, Jr.

*Assistant Examiner*—Carl D. Friedman

*Attorney, Agent, or Firm*—Scrivener, Clarke, Scrivener and Johnson

[57] ABSTRACT

In a composite section for making up window frames and the like, and comprising interengaging sections of metal and of plastics, there are at least two spaced-apart pairs of interengaging hook formations on the two sections, forced into tight engagement by the insertion of a wedging strip between the sections, the spacing apart of the formations ensuring stability against tilting. There are furthermore abutment surfaces on at least one of the hook formations on the plastics section and on the metal section to define accurately the relative positions of the sections. The purpose is primarily to ensure the front and back faces of the composite section are truly parallel and correctly spaced apart.

8 Claims, 2 Drawing Figures

FRAMES FOR WINDOWS AND OTHER PANELS

Figure 1:
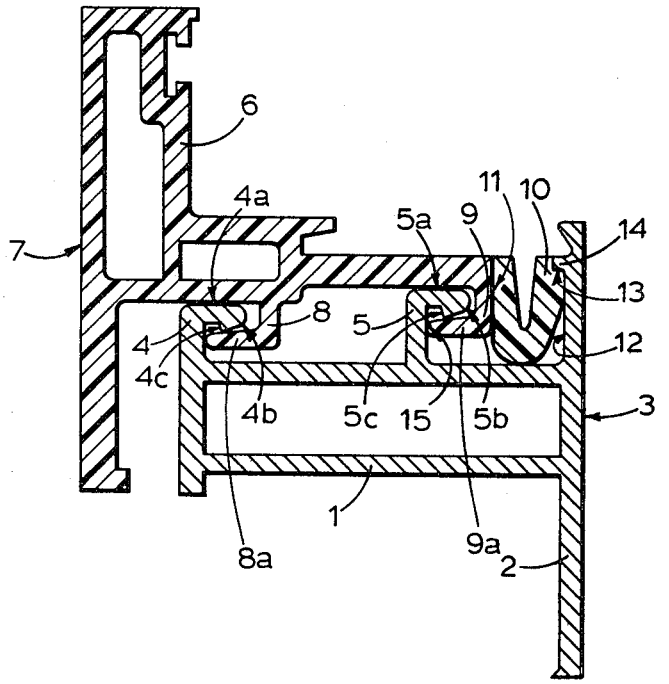

This invention relates to frames, primarily for windows, although such frames may be applied also to other forms of panel used in building construction.

A known drawback of extruded aluminium alloy or other metal frames is their high thermal conductivity, the effect of which partially negates the value of using double glazing to restrict loss of heat. Frames made of extruded plastics material are known, especially in continental Europe, but in order to have adequate rigidity they have to be of relatively heavy section, making them expensive in terms of material cost, and anyway there can be a danger of distortion that may create problems when the corners are mitred.

Composite frames are also known, comprising inner and outer extruded metal sections separated by a so-called 'thermal break' in the form of a section of plastics material that is either bonded to the metal, or mechanically keyed to it, or both. Finally, it is known to have simply two extrusions, one of plastics and one of metal, keyed together. In both these composite forms of frame, the keying together of the rigid metal section and the less rigid plastics extrusion can be a problem and despite the use of relatively complex interlocking sections with various ribs, flanges and rebates, there is the danger that the frames may come apart, especially when subjected to the very rough handling that they may receive during delivery and erection.

In particular, proposals have been made involving hook-like projections on the metal section and on the extruded plastics sections, which interengage, and then the two parts are held together by the insertion of a series of spaced apart wedges held in by friction, or in some cases a single continuous wedge section held in place by screws. However, these known arrangements do not allow for any tolerances in the dimensions of the parts.

There are two important factors to be taken into account in practice in the assembly of rectangular frames from composite sections of combined metal and plastics section. In the formation of such frames, lengths of the composite section are cut to the required length, with mitred ends, and then joined together at the corners by special L-shaped connecting pieces. If the front and back surfaces of the composite section are not truly parallel the corner joint is distorted, so that the two sides of the rectangle that meet at that corner fail to lie in a common plane, and the whole frame takes on a twisted state. Secondly, if the front and back faces are, due to tolerance variations, not exactly the right distance apart, the result is likewise an overall distortion of the frame. These two factors are not adequately dealt with in the known constructions.

The aim of the invention is to provide a composite section for use in the formation of frames, which section takes the above-mentioned factors into account and ensures truly parallel and correctly spaced front and back faces despite possible tolerance variations in the metal and plastics section that go to make up the composite section.

According to the invention, in a composite section suitable for forming rectangular frames and made up of at least one rigid metal section and at least one less rigid plastics section mechanically keyed together by the use of interengaging hook formations on the two sections, in co-operation with wedging means to hold them together, there are at least two separate spaced-apart hook formations on each of the two interengaging sections, both hook formations facing in the same direction and at least one of the hook formations is of tapering profile to provide a wedging action and at least one of the hook formations (it may be the same one) has an abutment surface engaging a co-operating abutment surface on the other section to define accurately the relative positions of the interengaging hook formations, the two spaced sets of hook formations being simultaneously locked in position by the insertion of a continuous wedge profile that is held locked in place by co-operation of its own shape with one of the sections.

By the provision of two spaced sets of hook formations we ensure that there can be no relative tilting of the metal section on the one hand and the plastics section on the other hand, so that their external faces remain truly parallel, and the provision of the abutment surfaces on one of the sets of hook formations ensured that those faces are the correct distance apart.

Figure 2:
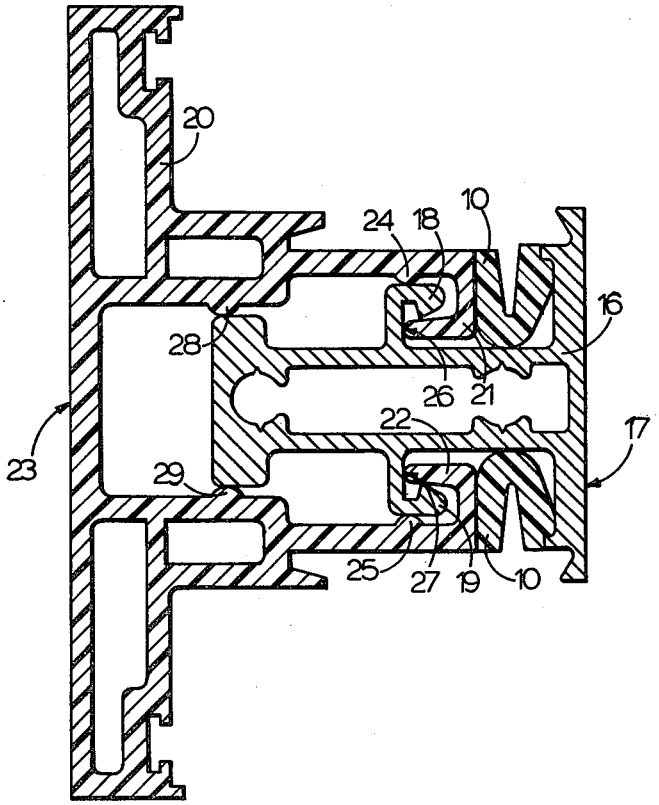

The invention will now be described by way of example with reference to the accompanying drawings, in which FIGS. 1 and 2 are cross-sections through two examples of composite sections made in accordance with the invention.

Referring first to FIG. 1, and extruded metal section 1 of aluminium alloy is basically in the form of a rectangular hollow box section but with an extended front flange 2 having a flat front face 3. On one side of the box section there are two L-shaped hook formations 4 and 5, widely spaced apart in a direction perpendicular to the plane of the face 3. Both hook formations point in the same direction, i.e. towards the face 3. One limb of each hook is parallel to that face and the other limb, which points towards it, has a rounded nose and has one side, 4*a*, 5*a* perpendicular to the face 3 and the other side 4*b*, 5*b* inclined at 15° to that perpendicular. This inclined side has a step or shoulder, 4*c*, 5*c*, directed away from the face 3.

Co-operating with the metal section 1 is a section 6 of plastics material, preferably unplasticised PVC. It is of complex form, comprising two linked hollow box sections, and a flat face 7 which defines the rear face of the overall composite section that is formed by the sections 1 and 6. The section 6 has two spaced-apart L-shaped hook formations 8 and 9, both facing in the same direction, i.e. towards the face 7, and co-operating respectively with the hook formations 4 and 5 on the metal section 1. The free limb 8*a*, 9*a* of each hook formation 8, 9 tapers towards its free end (for example with its inner face inclined at 5° to a line perpendicular to the face 7) and terminates in a rounded nose.

When the two sections 1 and 6 have been caused to interengage, with the hook formations 4 and 5 engaging the hook formations 8 and 9, a continuous resilient wedge section 10 of unplasticised PVC is forced into the gap between a face 11 on the back of the hook 9 and a face 12 on the inside of the front flange 2. A rebate 13 on the wedge section 10 engages under a shoulder defined by a head 14 on the flange 2, so as to hold the wedge permanently and virtually irremovably in place.

The insertion of the wedge 10 causes the respective hook formations to become tightly engaged and the lateral dimensions of the free limbs of the hooks 4 and 5 are such, in relation to the width of the channels defined by the free limbs of the hooks 8 and 9, that they distort these hooks 8 and 9 at least to some extent, and so ensure complete freedom from play in both sets of hook formations, despite possible tolerance variations in the plastics section or the metal section, or both. Moreover the nose of at least the hook 9 engages a face 15 on the one limb of the hook 5 to define the degree of engagement of the hook formations, the face 15 being in a plane parallel to the faces 3 and 7.

Thus the spacing apart of the pairs of hook formations, combined with the wedging action, ensures freedom from play or tilt between the sections 1 and 6, and so the faces 3 and 7 are truly parallel. Secondly, the abutment of the nose of the hook 9 against the face 15 on the hook 5 defines accurately the relative positions of the sections 1 and 6 in a direction perpendicular to the planes of the faces 3 and 7, and so the spacing apart of those faces, i.e. the overall front-to-back thickness of the composite section, is accurately determined. These two factors ensure that a frame built up from lengths of this composite section, is free from distortion and that its front and back faces are flat.

It will be understood that the flanges, undercuts and rebates that are visible in FIG. 1 but have not been described are for the purpose of receiving glazing, and other mounting and sealing strips, not shown.

FIG. 2 illustrates a symmetrical composite section, suitable for forming mullions within a rectangular frame made from the section of FIG. 1. An aluminium alloy extrusion 16 comprises a box section with a front face 17, and with two hook formations 18 and 19, spaced apart and lying on opposite sides of the box but both pointing towards the plane of the face 17. An extrusion 20 of unplasticised PVC is based on a combination of two back-to-back mirror image versions of the extrusion 6 of FIG. 1, but with one hook formation from each omitted, so there is a total of only two hook formations 21 and 22, co-operating respectively with the hook formations 18 and 19 of the section 16. The plastics extrusion has a flat rear face 23. The wedge section 10 that holds the two extrusions together is substantially the same as that of FIG. 1 but in this case two lengths of this wedge sections are used. In the version of FIG. 2 there are shallow beads 24 and 25 on the plastics extrusion to engage the backs of the hook formations 18 and 19. These beads help to define accurately the effective widths of the channels which the hooks 18 and 19 enter, and ensure that they become wedged, distorting the plastics and free from play. Like the hook 9, the nose of each hook 21 and 22 engages an abutment face 26 and 27 on the co-operating hook of the metal section to define accurately the spacing between the faces 17 and 23. The parallelism of these faces is ensured by the wide lateral spacing of the two pairs of co-operating hook formations, in combination with their wedging action.

Additional stability is provided by beads 28 and 29 on the plastics section, engaging opposite sides of the inner end of the metal section 16.

I claim:

1. A composite section of indefinite length suitable for forming rectangular frames, said composite section comprising a first section made of rigid metal, a second section made of plastics less rigid than said metal section, first and second hook formations on said first section, both of said hook formations being spaced apart and pointing in the same direction, third and fourth hook formations on said second section, said third and fourth hook formations being spaced apart and pointing in the same direction and adapted to engage respectively in said first and second hook formations, at least one of said first and second hook formations being of tapering profile, whereby to achieve a wedging action with the co-operating third or fourth hook formation, a first abutment surface on said third hook formation, a second abutment surface on said first section, and wedging means, said wedging means comprising a strip of indefinite length adapted to be inserted between said first and second sections whereby to force said spaced-apart first and third hook formations and said second and fourth hook formations into tight play-free engagement and simultaneously bringing said abutment surfaces into tight mutual engagement.

2. The composite section set forth in claim 1 wherein said first and second sections have respective flat first and second faces, and wherein said faces lie in parallel planes and said hook formations point in directions perpendicular to said planes.

3. The composite section set forth in claim 1 wherein first and second sections have respective flat first and second faces, and wherein said faces lie in parallel planes and said hook formations are spaced apart in a direction perpendicular to said planes.

4. The composite section set forth in claim 1 wherein said first and second sections have respective flat first and second faces, and wherein said faces lie in parallel planes and said hook formations are spaced apart in a direction parallel to said planes.

5. The composite section set forth in claim 4 including second wedging means, said second wedging means comprising a strip of indefinite length adapted to be inserted between said first and second sections in a region spaced from said first-mentioned wedging means.

6. The composite section set forth in claim 5 including opposed abutment beads on said second section, said abutment beads engaging opposite sides of said first section at points spaced away from said hook formations.

7. The composite section set forth in claim 1 including an undercut step on at least one of said first and second hook formations.

8. The composite section set forth in claim 1 wherein said first abutment surface comprises a nose on said third hook formation and said second abutment surface comprises a face on said first hook formation.

* * * * *